US005466359A

United States Patent [19]

Kabei

[11] Patent Number: 5,466,359

[45] Date of Patent: Nov. 14, 1995

[54] METHOD OF MANUFACTURING MICROWAVE TUBE COLLECTOR

[75] Inventor: Toshihiro Kabei, Tokyo, Japan

[73] Assignee: NEC Corporation, Japan

[21] Appl. No.: 317,330

[22] Filed: Oct. 4, 1994

[30] Foreign Application Priority Data

Oct. 7, 1993 [JP] Japan ..... 5-251263

[51] Int. Cl.[6] ..... C25D 5/48; C25F 3/04; C23C 14/14

[52] U.S. Cl. ..... 205/109; 205/110; 205/223; 427/437; 427/443.1

[58] Field of Search ..... 205/109, 110, 205/223; 427/437, 443.1

[56] References Cited

U.S. PATENT DOCUMENTS 4,119,500 10/1978 Ishizuka et al. ..... 204/16

FOREIGN PATENT DOCUMENTS 63-939 1/1988 Japan .
2-118080 5/1990 Japan .
2-213498 8/1990 Japan .

*Primary Examiner*—John Niebling
*Assistant Examiner*—Edna Wong
*Attorney, Agent, or Firm*—Ostrolenk, Faber, Gerb & Soffen

[57] ABSTRACT

According to a method of manufacturing a microwave tube collector of this invention, a copper plating layer in which powder particles of a material having a secondary electron emissivity of not more than 1 are dispersed and precipitated is formed on a surface of a collector electrode. Only the copper plating layer is selectively etched for a predetermined period of time to increase the degree of exposure and the surface area of the powder particles of the material having a secondary electron emissivity of 1 or more in the copper plating layer.

5 Claims, 4 Drawing Sheets

METHOD OF MANUFACTURING MICROWAVE TUBE COLLECTOR

BACKGROUND OF THE INVENTION

The present invention relates to a method of manufacturing a collector for a microwave tube such as a traveling-wave tube or a klystron.

A microwave tube such as a traveling-wave tube or a klystron is used in various fields of communication, television broadcasting, radar, industrial heating, nuclear fusion, and the like. In recent years, the microwave tube has been important. Especially, in the field of satellite communication, a microwave tube having high-efficiency, high-frequency, and high-output characteristics is demanded. As an amplifier in this field, a microwave tube such as a traveling-wave tube or a klystron is demanded. In a recently desired microwave tube to be mounted in a satellite, an increase in efficiency of the microwave tube is the most important problem because the number of microwave tubes mounted in a satellite is limited.

A beam rectilinear type microwave tube generally amplifies and oscillates a microwave using an electron beam. FIGS. 3A and 3B show a traveling-wave tube which is a typical beam rectilinear type microwave. This traveling-wave tube is mainly constituted by an electron gun unit 4, a high-frequency circuit unit 5, and a collector unit 6. Hot electrons are emitted from a cathode 7 of the electron gun unit 4, accelerated by a grid and an anode, and incident on the high-frequency circuit unit 5. In the high-frequency circuit unit 5, an incident electron beam 8 interacts with a high-frequency signal input from an input portion 9, and this high-frequency signal is amplified and extracted from an output portion 10. In the collector unit 6, the electron beam 8 which interacts with the high-frequency signal is captured, and the kinetic energy of the electron beam 8 is converted into heat energy.

In order to increase the efficiency of such a traveling-wave tube, the recovery efficiency of the electron beam 8 must be increased in, especially, the collector unit 6. Various conventional methods of increasing the recovery efficiency are provided. In a conventional collector, as shown in FIGS. 4A and 4B, a collector electrode has a multi-stage collector structure constituted by a first collector 62, a second collector 63, and a third collector 64, and a secondary electron preventing film 12 such as a graphite film, a titanium nitride film, or a titanium carbide film having a low secondary electron emissivity is formed on the surfaces of each collector. In the multi-stage collector structure, assuming that the potentials of the electrodes of the first collector 62, the second collector 63, and the third collector 64 are represented by Vc1, Vc2, and Vc3, respectively, and that the circuit voltage of the traveling-wave tube is represented by Vs, voltages are applied to the collectors to satisfy Vs>Vc1>Vc2>Vc3. The electron beam 8 which interacts with a high-frequency signal in the high-frequency circuit unit 5 is classified into electrons having different speeds by decelerating electric fields generated by the first collector 62, the second collector 63, and the third collector 64 and a diverging force generated by space charges. More specifically, the slowest electrons, the second slowest electrons, and the fastest electrons are incident on and captured by the first collector 62, the second collector 63, and the third collector 64, respectively.

The recovery rate of an electron beam by such a multi-stage potential gradient collector can be increased in proportion to the number of stages of the collector electrode. In practice, a collector having 2 to 4 stages is popularly used. In addition, each collector electrode captures the electrons of an electron beam which is incident on the collector electrode, and, at the same time, the collector electrode generates secondary electrons on its surface. These secondary electrons are accelerated toward a high-potential portion. As indicated by broken arrows in FIGS. 3B and 4A, when a larger number of reversely traveling electrons 11 are generated, the reversely traveling electrons 11 adversely affect the distortion characteristics of the traveling-wave tube to increase a helix current inside the high-frequency circuit. This causes the traveling-wave tube to vary in output so as to considerably impair the function of the traveling-wave tube.

For this reason, in a conventional technique, a graphite powder having a low secondary electron emissivity is coated on the surface of the collector electrode described above, and the resultant structure is used in practice. However, according to this method, a carbon powder is generated by vibration of a traveling-wave tube, an ion impact, or the like to decrease the operation efficiency of the traveling-wave tube. Therefore, the method cannot be properly applied to a high-output traveling-wave tube.

Note that a technique for coating a graphite film, a titanium nitride film, or a titanium carbide film on the surface of a collector electrode by a CVD (Chemical Vapor Deposition) method or a PVD (Physical Vapor Deposition) method to improve the adhesion properties of the secondary electron preventing film 12 is disclosed in Japanese Patent Laid-Open No. 63-939. Although these films are excellent in adhesion properties, each film has a relatively flat surface state, and the secondary electron preventing effect of each film is limited. Therefore, even when the above methods are used, an increase in efficiency of a traveling-wave tube is limited.

As a recent technique for improving a surface quality, a composite plating technique as shown in FIG. 5 is disclosed in Japanese Patent Laid-Open No. 2-213498 or 2-118080. According to this technique, hard powder particles 13 consisting of boron nitride, graphite, and the like are dispersed in a metal plating solution, and a composite plating layer 14 containing these hard particles 13 dispersed in a metal plating layer is precipitated on the surface of a metal material, thereby improving the surface characteristics (mainly, friction characteristics and lubrication characteristics) of a matrix. However, even when the dispersed particles are precipitated by the conventional composite plating technique, the degree of exposure and the surface area of the dispersed particles are not sufficient with respect to the secondary electron preventing effect of a metal part.

SUMMARY OF THE INVENTION

It is an object of the present invention to provide a method of manufacturing a microwave tube collector whose secondary electron emissivity is decreased.

It is another object of the present invention to provide a method of manufacturing a microwave tube collector which improves the efficiency of a microwave tube.

In order to achieve the above objects, according to the present invention, there is provided a method of manufacturing a microwave tube collector, comprising the steps of forming, on a surface of a collector electrode, a copper plating layer in which powder particles of a material having a secondary electron emissivity of not more than 1 are dispersed and precipitated, and selectively etching only the copper plating layer for a predetermined period of time to increase a degree of exposure and a surface area of the powder particles of the material having the secondary electron emissivity of not more than 1 in the copper plating layer.

The composite plating layer has the structure in which the powder particles are dispersed and precipitated in the copper plating layer. When only the copper plating layer serving as a matrix is selectively etched, the degree of exposure and the surface area of the powder particles can be increased. In addition, since the composite plating layer has the structure in which the powder particles are buried in the copper plating layer serving as the matrix, the powder particle layer is excellent in adhesion properties.

In the collector electrode formed as described above, the powder particles each having a low secondary electron emissivity are largely exposed, and an uneven surface state and a large surface area can be obtained. For this reason, the collector electrode has a large secondary electron preventing effect and can capture incident electrons at high efficiency.

DESCRIPTION OF THE PREFERRED EMBODIMENTS

Figure 1A:
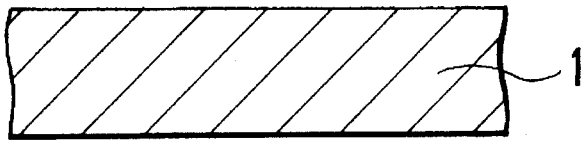
FIGS. 1A to 1C are sectional views sequentially showing the steps in manufacturing a film of a collector electrode to explain a method of manufacturing a microwave tube collector according to the first embodiment of the present invention.
Figure 1B:
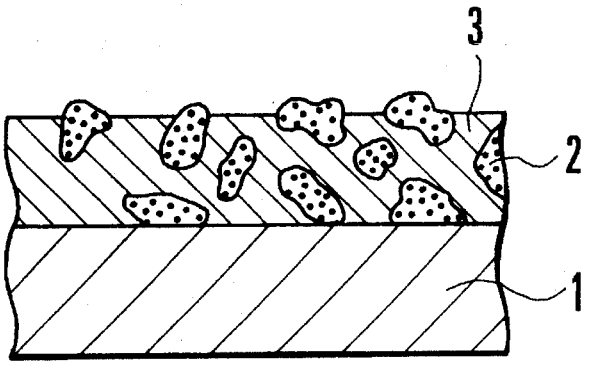
Figure 1C:
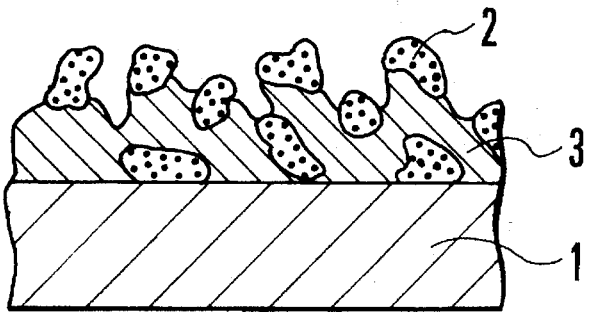

Embodiments of the present invention will be described below. FIGS. 1A to 1C sequentially show the steps in manufacturing a film according to the first embodiment of the present invention. A collector electrode 1 shown in FIG. 1A consists of an oxygen-free copper material. As shown in FIG. 1B, a copper plating layer 3 in which graphite particles 2 having a secondary electron emissivity of 1 or less were dispersed was formed on the surface of the collector electrode 1 to have a thickness of 15 μm. Note that the copper plating layer 3 may have a thickness of 5 μm or more such that the collector electrode 1 is not exposed by etching (to be described later). A solution mixture obtained by mixing 100 g/l of aqueous colloidal graphite serving as a graphite powder into a copper cyanide plating solution consisting of 50 g/l of copper cyanide, 20 g/l of potassium hydroxide, and 90 g/l of potassium cyanide was used as a plating bath, and composite plating was performed while this plating bath was stirred to prevent the graphite powder from being agglomerated and precipitated. The temperature of the plating bath was set to be 50° C., and a current density was set to be 1 $A/dm^2$.

Figure 2:
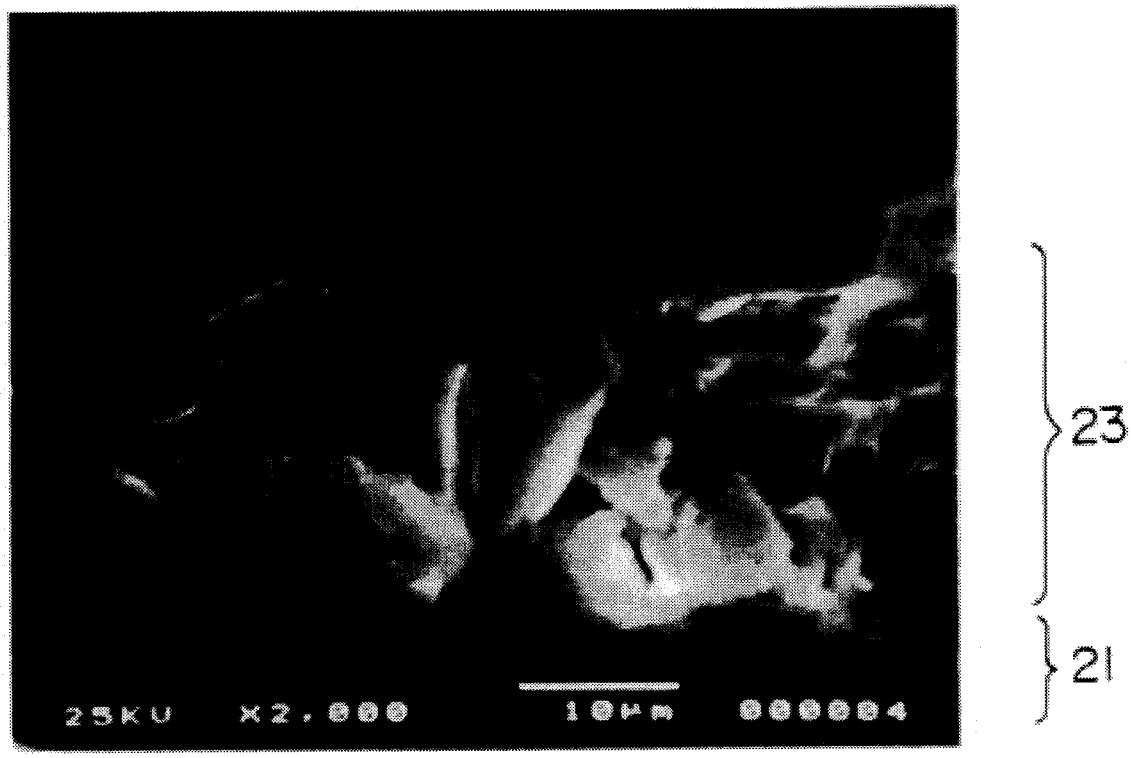
FIG. 2 is a photograph showing a ×2,000 SEM image of the section of the film of the collector electrode obtained by the method of the present invention.
Figure 3A:
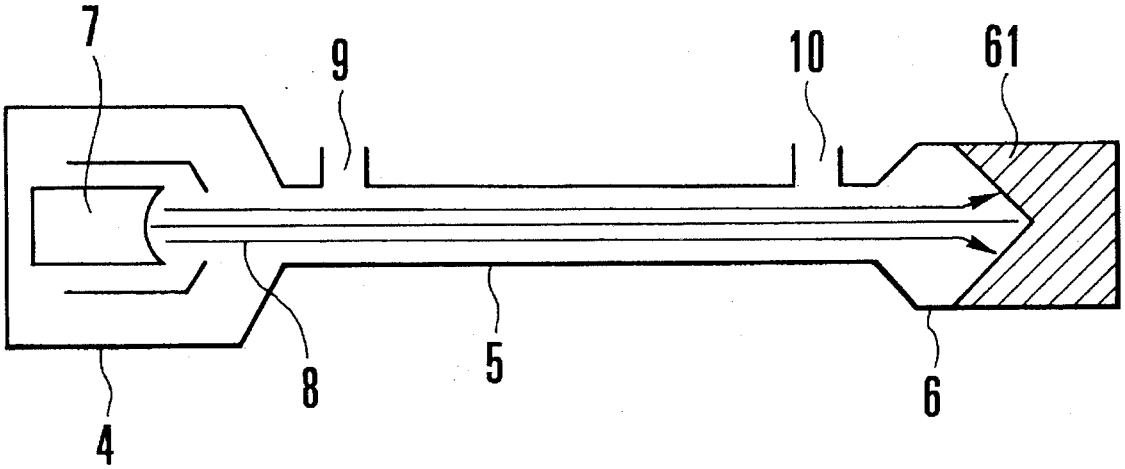
FIG. 3A is a schematic sectional view showing the arrangement of a conventional traveling-wave tube.
Figure 3B:
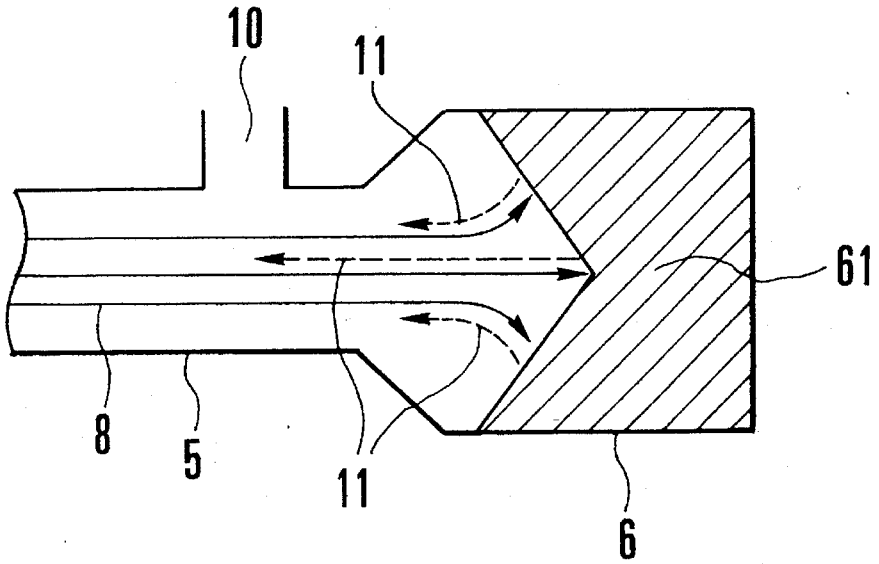
FIG. 3B is an enlarged sectional view showing part of the collector unit shown in FIG. 3A.
Figure 4A:
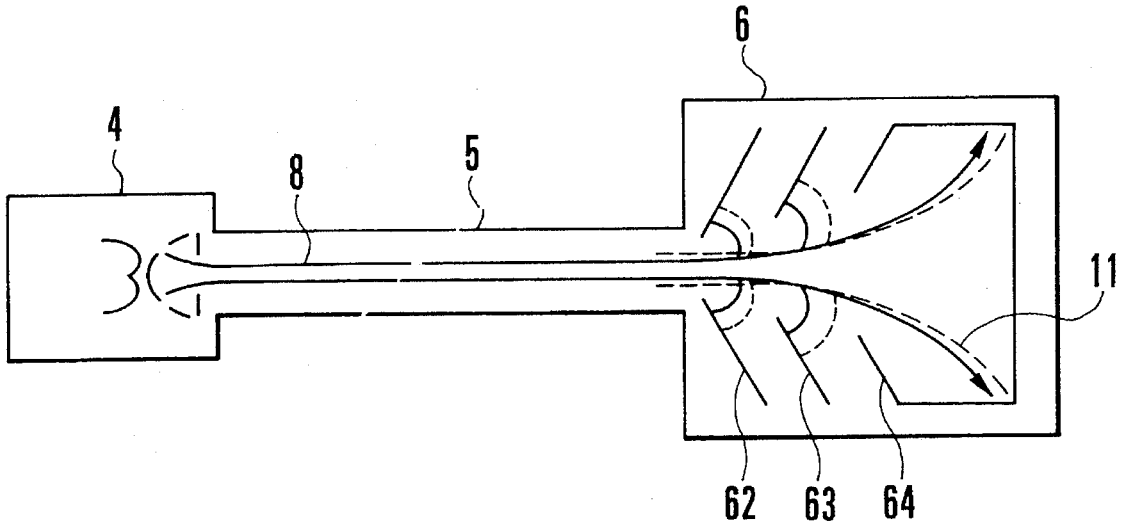
FIG.4A PRIOR ART
FIG. 4A is a schematic sectional view showing the arrangement of a conventional traveling-wave tube having a multi-stage collector.
Figure 4B:
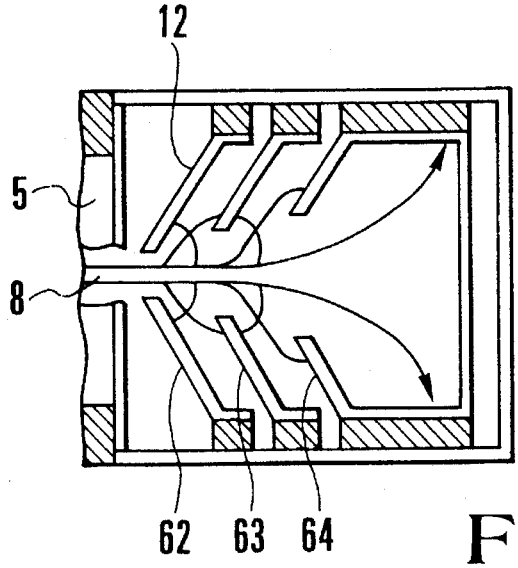
FIG.4B PRIOR ART
FIG. 4B is a enlarged sectional view showing part of the collector unit shown in FIG. 4A.
Figure 5:
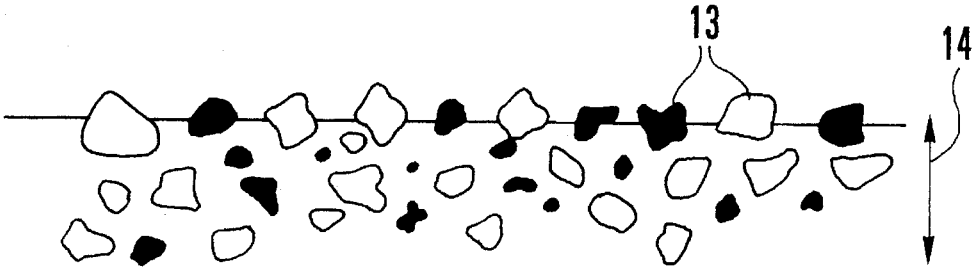
FIG.5 PRIOR ART
FIG. 5 is a sectional view showing a plating film obtained by conventional composite plating.

Using a solution mixture of 18 g/l of chromate anhydride and 30 ml/l of an aqueous 75% sulfuric acid solution was used as an etchant, only the copper plating layer 3 was etched at room temperature for 5 seconds to expose the graphite particles 2 as shown in FIG. 1C. A ×2,000 SEM (Scanning Electron Microscope) image of the section of the film manufactured as described above is shown in FIG. 1C. As is apparent from FIG. 2, the copper plating layer 3 serving as a matrix is removed by etching so as to increase the degree of surface exposure of the graphite particles 2 dispersed and precipitated in the copper plating layer 3. In addition, a film having an uneven surface state and a large surface area was obtained. In FIG. 2, reference numeral 21 denotes an underlying metal constituting the collector electrode 1, and reference numeral 23 denotes the coating layer constituted by the copper plating layer 3 on which the graphite particles 2 are largely exposed.

The collector electrode manufactured as described above was actually mounted on a traveling-wave tube, and the traveling-wave tube was evaluated. As a result, it was found that the efficiency of this traveling-wave tube was increased by 10% compared with a conventional traveling-wave tube. When the adhesion strength of the film was evaluated by a vibration test, inconvenience such as peeling or falling of the film did not occurs. Therefore, it was confirmed that the collector electrode could be practically used.

The second embodiment of the present invention will be described below. As a dispersant, a titanium nitride powder and a titanium carbide powder were used in place of the graphite powder. According to the second embodiment, a copper plating layer in which particles of the titanium nitride powder or a titanium carbide powder were dispersed and precipitated was formed on a collector electrode to have a thickness of 15 μm, and the copper plating layer was removed by the same method as described in the first embodiment to expose the titanium nitride particles or the titanium carbide particles, thereby forming a film on the collector electrode. Table 1 shows results obtained by evaluating secondary electron emissivities respectively obtained in the method of the present invention using a graphite powder, a titanium nitride powder, and a titanium carbide and secondary electron emissivities respectively obtained when a graphite-sprayed film, a sputtered titanium nitride film, and a sputtered titanium carbide film are used as secondary electron preventing films. As is apparent from these results, it was found that a film formed by the method of the present invention could obtain a secondary electron emissivity lower than that of a conventional film by 25% or more.

TABLE 1

| | Secondary Emissivity of Each Film | | |
|---|---|---|---|
| Plating | Dispersant (mixing amount, mean particle diameter) | Film Thickness | Maximum Secondary Electron Emmissivity |
| Method of Present Invention | | | |
| copper | graphite (100 g/1.5 μm) | 15 μm | 0.5 |
| | titanium nitride (100 g/1.3 μm) | 15 μm | 0.6 |
| | titanium carbide (100 g/1.3 μm) | 15 μm | 0.6 |

TABLE 1-continued

| Plating | Dispersant (mixing amount, mean particle diameter) | Film Thickness | Maximum Secondary Electron Emmissivity |
|---|---|---|---|
| Secondary Emissivity of Each Film | | | |
| Conventional Method | | | |
| graphite-sprayed film | | 2 μm | 0.8 |
| sputtered titanium nitride film | | 1 μm | 0.9 |
| sputtered titanium carbide film | | 1 μm | 0.9 |

As has been described above, according to the present invention, a film obtained such that a material powder having a secondary electron emissivity of 1 or less is dispersed and precipitated in a copper plating layer is formed on the surface of a collector electrode, and only the copper plating layer is selectively removed by etching, thereby increasing the degree of exposure and the surface area of the material powder. The film manufactured as described above has a secondary electron preventing effect improved by about 25% or more compared with a conventional film, and the efficiency of a microwave tube can be effectively increased.

What is claimed is:

1. A method of manufacturing a microwave tube collector, comprising the steps of:

forming, on a surface of a collector electrode, a copper plating layer in which there are powder particles of a material having a secondary electron emissivity of not more than 1 are dispersed and precipitated; and selectively etching only said copper plating layer to increase a degree of exposure and a surface area of said powder particles of the material having the secondary electron emissivity of not more than 1 in said copper plating layer.

2. A method according to claim 1, wherein the material having a secondary electron emissivity of not more than 1 is one material selected from the group consisting of graphite, titanium nitride, and titanium carbide.

3. A method according to claim 1, where said copper plating layer has a thickness of not less than 5 μm.

4. A method according to claim 1, wherein said collector electrode consists of an oxygen-free copper material.

5. A method of manufacturing a microwave tube collector, comprising the steps of:

forming, on a surface of a collector electrode that includes an oxygen-free copper material, a copper plating layer which has a thickness of not less than 5 μm and in which there are powder particles which are comprised of a material having a secondary electron emissivity of not more that 1 and selected from the group consisting of graphite, titanium nitride, and titanium carbide are dispersed and precipitated; and selectively etching only said copper plating layer to increase a degree of exposure and a surface area of said powder particles comprising a material selected from the group consisting of graphite, titanium nitride, and titanium carbide in said copper plating layer.

* * * * *